US007308732B2

(12) United States Patent
Woolcock

(10) Patent No.: US 7,308,732 B2
(45) Date of Patent: Dec. 18, 2007

(54) ADJUSTABLE HINGE ASSEMBLY

(75) Inventor: Timothy Woolcock, Chipping Norton (GB)

(73) Assignee: Ford Global Technologies, LLC, Dearborn, MI (US)

( * ) Notice: Subject to any disclaimer, the term of this patent is extended or adjusted under 35 U.S.C. 154(b) by 256 days.

(21) Appl. No.: 10/536,661

(22) PCT Filed: Nov. 27, 2003

(86) PCT No.: PCT/GB03/05218

§ 371 (c)(1),
(2), (4) Date: May 27, 2005

(87) PCT Pub. No.: WO2004/051040

PCT Pub. Date: Jun. 17, 2004

(65) Prior Publication Data

US 2006/0096062 A1 May 11, 2006

(30) Foreign Application Priority Data

Nov. 30, 2002 (GB) ..... 0228028.7

(51) Int. Cl.
*E05D 7/06* (2006.01)

(52) U.S. Cl. ..... 16/240; 16/238; 16/260; 16/382

(58) Field of Classification Search ..... 16/240, 16/238, 382, 245, 246, 260, 261, 367; 296/146.8, 296/146.9, 146.11, 146.12; 411/432, 433, 411/178, 366.1, 367
See application file for complete search history.

(56) References Cited

U.S. PATENT DOCUMENTS

| | | | | |
|---|---|---|---|---|
| 2,839,778 | A * | 6/1958 | Hutchinson et al. | 16/245 |
| 4,305,614 | A * | 12/1981 | Holka et al. | 296/37.16 |
| 4,590,642 | A * | 5/1986 | Hesener | 16/241 |
| 5,263,227 | A * | 11/1993 | Hrbek et al. | 16/224 |
| 5,340,258 | A * | 8/1994 | Simon | 411/535 |
| 5,492,388 | A * | 2/1996 | Kawasaki | 296/193.02 |
| 5,895,089 | A * | 4/1999 | Singh et al. | 296/207 |
| 2003/0042757 | A1 * | 3/2003 | Ohba | 296/146.11 |

FOREIGN PATENT DOCUMENTS

| | | | |
|---|---|---|---|
| DE | 3229732 | C * | 12/1983 |
| DE | 4034599 | A1 * | 2/1992 |
| EP | 73166 | A * | 3/1983 |
| EP | 892139 | A2 * | 1/1999 |
| EP | 1094184 | A1 * | 4/2001 |
| GB | 1518049 | A * | 7/1978 |

* cited by examiner

*Primary Examiner*—Chuck Y. Mah
(74) *Attorney, Agent, or Firm*—Gigette M. Bejin; Dickinson Wright PLLC

(57) ABSTRACT

A hinge assembly 15 for a vehicle tailgate 14 comprises a first hinge member 21 fastened to the tailgate 14 and a second hinge member 22 fastened to a hollow flange 23 of a vehicle roof 13 by means of adjustment device 24 comprising an adjustment nut 25 and a locking screw 26. The second hinge member 22 has a hollow cylindrical shank portion 35 with a left-hand external screw thread 36 and a right-hand internal thread 38. Further, the adjustment nut 25 having a screw thread 39 engaged with the external thread 36 of the hollow shank portion 35 and the locking screw 26 having a screw thread 41 engaged with the internal thread 38 of the hollow shank portion 35.

15 Claims, 5 Drawing Sheets

ADJUSTABLE HINGE ASSEMBLY

TECHNICAL FIELD

The invention relates to adjustable hinge assemblies, and particularly but not exclusively to an adjustable hinge assembly for pivotally securing a tailgate, door, or other closure of a vehicle to a portion of the vehicle body structure.

BACKGROUND OF THE INVENTION

Typically, the doors or tailgate of a vehicle, particularly a motor vehicle, are pivotally connected to the body structure by means of two or more hinges. Usually, these hinges have one plane of adjustment between the hinge and the body structure and one plane of adjustment between the hinge and the door or closure. Because the hinge is normally first attached to the closure and then to the body structure, there is only one plane of adjustment unless the fasteners, which have already been tightened, are released and then re-tightened. This release and re-tightening process often introduces errors in the positioning of the closure and is also time consuming and disruptive in a production line environment.

EP-A-1094184 shows a hinge assembly which attempts to overcome the above problems. The hinge assembly includes an adjustment nut, a locking screw, and a hinge member. The adjustment nut comprises a clamp face, which faces one side of a flange on the vehicle body structure. The locking screw has a head, which can clamp onto the other side of the flange, and a shank, which extends through the flange and engages an internal screw thread in the nut. The nut also has an external screw thread which engages an internal thread in the hinge member and thus provides an adjustment means in the axial direction of the nut. However, when the screw is tightened to clamp the nut to the flange, the hinge member remains loose on its threads on the nut. Although the hinge member cannot rotate, this looseness can, over a period of time, cause fretting corrosion and other problems which would not arise if all components were firmly clamped.

SUMMARY OF THE INVENTION

The present invention provides an improved hinge assembly where the above problems are prevented or alleviated.

In one embodiment of the invention, a hinge assembly is provided for pivotally connecting a closure member to a support structure. The hinge assembly comprises a first hinge member, a second hinge member, a pivot means pivotally coupling the first hinge member to the second hinge member, and an adjustment means carried by the second hinge member. The first hinge member is utilized for fastening to one of the closure member and the support structure. The second hinge member is utilized for fastening to a flange on the other of the support structure and the closure member. The adjustment means connects the second hinge member to the flange and allows adjustment of the position of the second hinge member with respect to the flange. The adjustment device comprises an adjustment nut and a locking screw. The adjustment nut has a first clamp face, which in use faces one side of the flange. Further, the locking screw has a head defining a second clamp face, which in use faces the other side of the flanges and a shank, which in use extends through an aperture in the flange. Moreover, the second hinge member comprises a cylindrical shank portion having a concentric bore with internal and external screw threads. The adjustment nut has a screw thread engaged with the external screw thread of the cylindrical shank portion. The locking screw has a screw thread engaged with the internal screw thread of the cylindrical shank portion.

Preferably, the external screw thread of the cylindrical shank portion and the screw thread of the adjustment nut are of the opposite hand to the internal screw thread of the cylindrical shank portion and the screw thread of the locking screw. In particular, for convenience in use, the external screw thread of the cylindrical shank portion and the screw thread of the adjustment nut preferably are left-hand, and the internal screw thread of the cylindrical shank portion and the screw thread of the locking screw are right-hand.

In this embodiment, the hinge assembly further comprises a friction means on one of the locking screw and the adjustment nut for providing a driving torque between the locking screw and the adjustment nut.

Also, in this embodiment, the adjustment nut includes a drive means used to facilitate rotation of the adjustment nut during adjustment of the hinge assembly. The drive means may be in a bore of the adjustment nut and preferably is a hexagonal shaped portion of the bore.

In a second embodiment of the invention, a motor vehicle having a body structure and a closure member connected to the body structure by the hinge assembly in accordance with the above. In such a case, the flange comprises two spaced apart flange members defining a cavity therebetween. The adjustment nut is positioned so as to react against one of the flange members, and the locking screw is arranged so as to react against the other of the two flange members. In this embodiment, a tubular spacer may be positioned in the cavity between the flange members to react a clamping force applied to the flange members by the locking screw and the adjustment nut.

Yet another embodiment of the invention is a method for attaching a closure member to a body structure of a motor vehicle in accordance with the above. The method comprises supplying the first hinge member, the second hinge member, and the adjustment nut with the first hinge member and the second hinge member pivotally connected by the pivot means and the adjustment nut threaded onto the cylindrical shank portion. The method further includes the step of aligning the cylindrical shank portion with the aperture in the flange to conform to the required position of the closure member relative to the body structure. Another step comprises rotating the adjustment nut on the cylindrical shank portion to conform to said required position. Yet another step comprises inserting the locking screw through the aperture in the flange to engage the adjustment nut. The final step includes rotating the locking screw to clamp the hinge assembly to the flange.

Preferably, the closure member is positioned and held in the required position prior to rotating the adjustment nut on the cylindrical shank portion to conform to the required positions. The adjustment nut is then rotated to bring the first clamp face into supporting contact with the flange. The closure member may be held in the required position by an assembly fixture to which it is releasably attached.

Preferably, the adjustment nut is rotated until a predetermined tightening torque is reached. Conveniently, when the hinge assembly comprises friction means on one of the locking screw and the adjustment nut for providing a driving torque between the locking screw and the adjustment nut. The adjustment nut is rotated by said friction means during the rotation of the locking screw.

BRIEF DESCRIPTION OF THE DRAWINGS

The invention will now be described by way of example with reference to the to accompanying drawings.

DETAILED DESCRIPTION OF THE INVENTION

Figure 1:
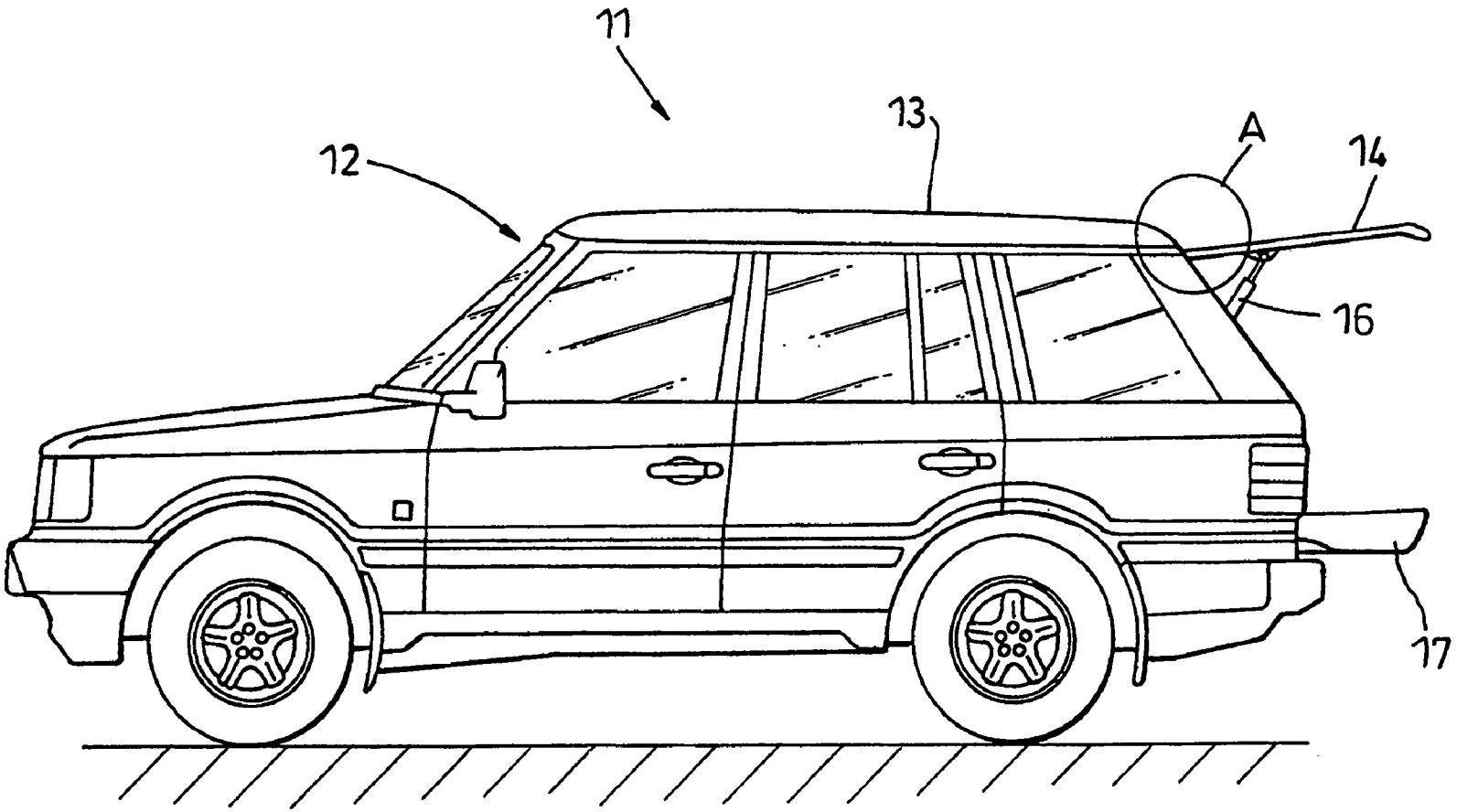
FIG. 1 is a side elevation view of a motor vehicle incorporating a hinge assembly according to one embodiment of the invention.
Figure 2:
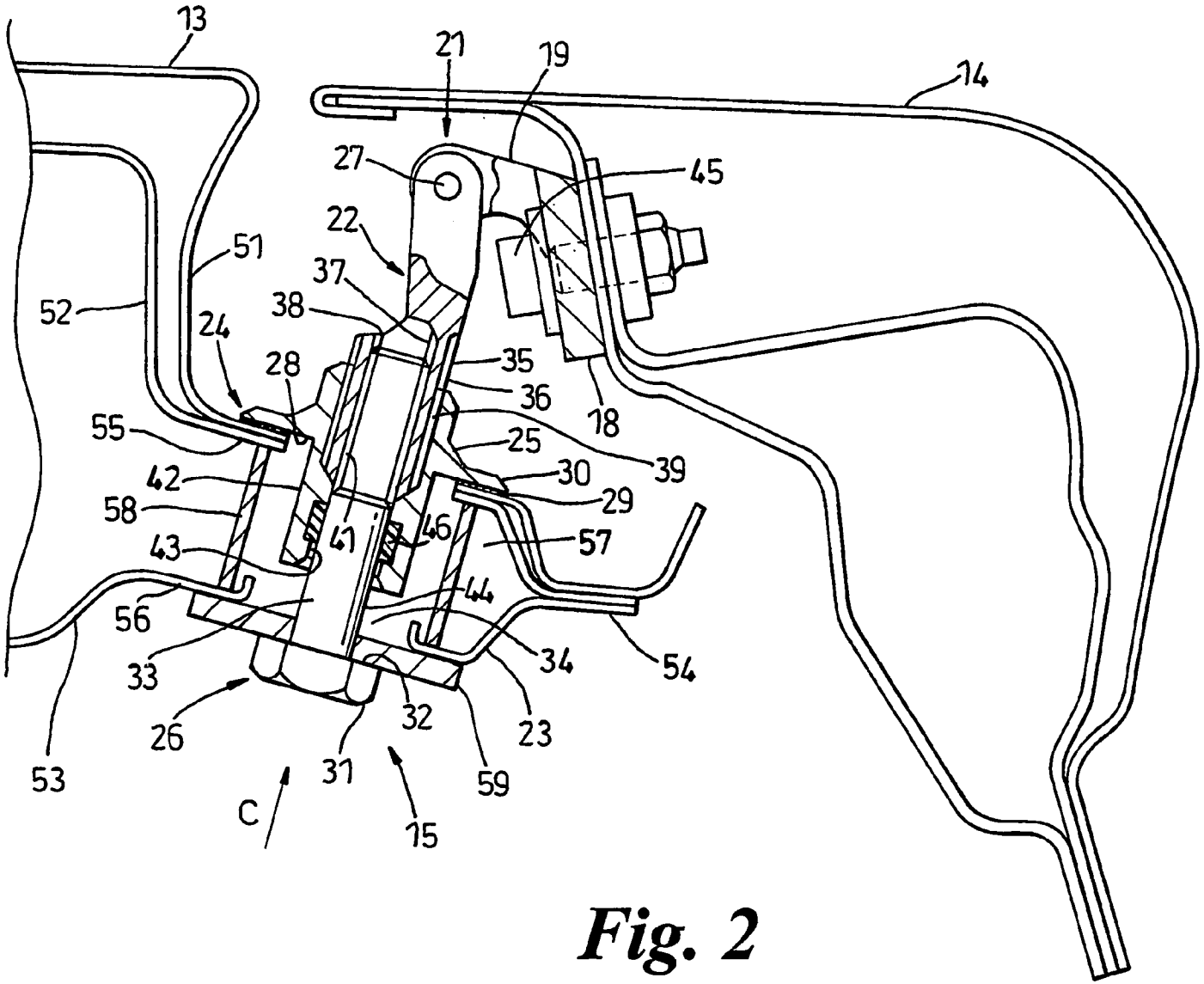
FIG. 2 is an enlarged cross-sectional view of the motor vehicle shown in FIG. 1, as taken from the region encircled at A and showing the hinge assembly.
Figure 3:
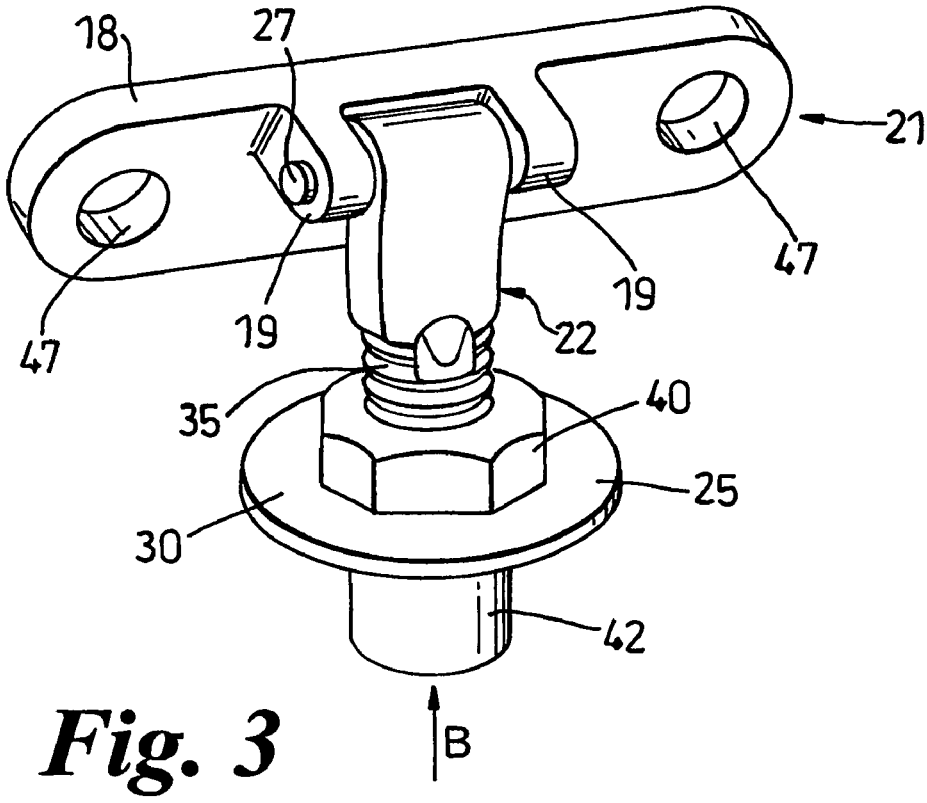
FIG. 3 is a perspective view of a portion of the hinge assembly shown in FIG. 1.

Referring to FIGS. 1 to 3, a motor vehicle 11 has a body structure 12 including a roof 13 to which is hinged an upper tailgate 14 by means of a pair of adjustable hinge assemblies 15. The upper tailgate 14 is supported in the open position by a pair of gas struts 16. A lower tailgate 17 is also provided. Such tailgates 14, 17 and other doors of the vehicle are usually referred to as closure members or simply closures.

Each hinge assembly 15 comprises a first hinge member 21 pivotally connected to a second hinge member 22, which is fastened to a hollow flange 23 by means of an adjustment device 24 comprising an adjustment nut 25 and a locking screw 26. The hollow flange 23 forms part of the roof 13, which thus acts as a support structure for the hinge assembly 15. The first hinge member 21 has a base flange 18 for fastening to the upper tailgate 14 and two lugs 19, which extend from either side of the second hinge member 22 to support a pivot means. The pivot means is comprised of a pivot pin 27, which extends through the lugs 19 and the second hinge member 22. The adjustment nut 25 has a flange 30 with a lower face 28, which defines a first clamp face facing the upper side of the flange 23 and which carries a sealing gasket 29. The locking screw 26 has a hexagonal head 31 and a solid shank 33. The hexagonal head 31 has an underside defining a second clamp face 32 that faces the lower side of the flange 23. The solid shank 33 extends through an aperture 34 in the hollow flange 23.

The second hinge member 22 has a hollow cylindrical shank portion 35 with an external screw thread 36 and a concentric bore 37 with an internal screw thread 38. The adjustment nut 25 has a screw thread 39 engaged with the external screw thread 36 of the hollow shank portion 35. Similarly, the locking screw 26 has a screw thread 41 engaged with the internal screw thread 38 of the hollow shank portion 35.

The adjustment nut 25 has a hexagonal head 40 above the flange 30 and a tubular spigot projecting below the lower face 28 of the flange 30. The hexagonal 40 is utilized as a drive means for holding or rotating the nut during assembly and adjustment. Further, the tubular spigot 42 has a plain bore 43, which surrounds a plain shank portion 44 of the locking screw 26. A recess in the bore 43 of the adjustment nut 25 carries a ring 46 (conveniently referred to as a friction ring) of a resilient plastics material that acts as a friction means for providing a driving torque between the locking screw 26 and the adjustment nut 25.

The hollow flange 34 is formed by an upper Pressing 51, an intermediate pressing 52, and a lower pressing 53. The upper pressing 31 forms the outer skin of the roof 13. The intermediate pressing 52 forms the inner skin of the roof 13 and is in close contact with the upper pressing 51 in the region of the hollow flange 34. The lower pressing 53 forms part of a tailgate opening in the body structure 12. The upper pressing 51, intermediate pressing 52, and lower pressing 53 are joined at an outer flange 54. The upper pressing 51 and the intermediate pressing 52 thus form an upper flange member 55, which is spaced apart from a lower flange member 56 formed by the lower pressing 53 to define a cavity 57 therebetween. The adjustment nut 25 is positioned to react against the upper flange member 55. Similarly, the locking screw 26 is arranged so as to react against the lower flange member 56. A tubular spacer 58 is positioned in the cavity 57 between the flange members 55, 56 to react a clamping force applied to the flange members by the locking screw 26 and the adjustment nut 25. The locking screw 26 applies the clamping force through a washer 59 that is sandwiched between the head 31 and the lower flange member 56.

The external thread 36 on the hollow shank portion 35 of the second hinge member 22 is of the opposite hand to the internal thread 38 for reasons which will be explained later. In this particular example, the external thread 36 and the corresponding thread 39 in the adjustment nut 25 are left-handed while the internal thread 38 and the corresponding thread 41 on the locking screw 26 are right-handed. This allows the use of a commercially available standard fastener for the locking screw 26.

Setting of the hinge assembly 15 is as follows. As shown in FIG. 2, first and second hinge members 21 and 22 are provided as a sub-assembly complete with the pivot pin 27 and with the adjustment nut 25 threaded as far as it will go onto the shank portion 35 of the second hinge member 22. The first hinge member 21 is then fastened to the tailgate 14 using cap screw fasteners 45 inserted through holes 47 in the base flange 18. The tailgate 14 is then moved into a required position corresponding to the correct position of the tailgate relative to the body structure 12 using an assembly fixture (not shown) to which the tailgate is releasably secured. In this embodiment, the assembly fixture is carried by a robot to grasp the tailgate 14 and hold it in the desired position corresponding to the normal closed position of the tailgate. This step preferably is performed during the assembly of the vehicle before painting and before any seals have been put onto the tailgate 14 or onto the body structure. Also, this step preferably is performed before the vehicle is glazed so as to provide ready access to the inside of the vehicle for robot arms or human operators to insert and tighten the locking screws 26.

The spigot 42 of the adjustment nut 25 is positioned in the clearance aperture 34 at the time that the tailgate 14 is being brought into its correct position, the spacer 58 having already been placed in position during fabrication of the body structure 12. The tailgate 14 having been positioned correctly, the hinge assembly 15 is adjusted to ensure that the tailgate 14 will be in the correct position relative to the body structure 12 when the assembly fixture is released. This is done by inserting the locking screw 26, with the washer 59 in place, into the bore 43 of the adjustment nut 25 until the threaded 41 engages the friction ring 46. The threaded 41 winds into the friction ring 46 with a self-tapping action until the friction grip between the locking screw 26 and the adjustment nut 25 provides sufficient torque for the locking screw 26 to rotate the adjustment nut 25 in the clockwise direction (as viewed in the direction of arrow C in FIG. 2). This causes the adjustment nut 25 to move along the shank portion 35 of the second hinge member 22 in the direction away form the pivot pin 27 until the lower face 28 (or rather the gasket 30) engages the upper flange member 55. The locking view 26 will then continue to rotate without further rotation of the adjustment nut 25 so that the thread 41 winds through the friction ring 46 and engages the internal thread 38 of the adjustment nut 25, thus bringing the washer 59 up to the lower flange member 56 and clamping the hinge assembly 15 to the flange 23. After the locking screw 26 has been tightened to the required torque, the tailgate 14 is released from the assembly fixture to allow it to rotate normally with respect to the body structure 12.

The clearance between the spigot 42 of the adjustment nut 25 and the aperture 34 in the hollow flange 34 is normally sufficient to allow the assembly fixture to move the tailgate 14 into the correct longitudinal and lateral positions when the spigot 42 is located in the aperture 34. If minor adjustments are required to the hinge assembly 15 during the service life of the vehicle 11, then the hexagon 40 on the adjustment nut 25 can be used to rotate the adjustment nut 25.

By providing the first and second hinge members 21 and 22 as a sub-assembly with the adjustment nut 25 threaded as far as it will go onto the cylindrical shank portion 35 of the second hinge member 22, the threads 36 and 38 are protected during transport and handling. Furthermore, because the locking screw 26 acts directly on the second hinge member 22, it tightens its own thread 41 with the internal thread 38 of the second hinge member 22 and also tightens the external thread 36 of the second hinge member with the thread 39 of the adjustment nut 25. In this way, all the components of the adjustment device 24 are firmly clamped.

It is contemplated that other friction means may be employed instead of the friction ring 46. For example, the shank 33 of the locking screw 26 may be coated with a plastics material or may be sleeved by a tube of such material, e.g. by heat shrinking. This would enable the use of a plain bore in the adjustment nut 25 without the recess for the friction ring 46. A metal collar incorporating a spring grip device could also be used. Such collars are sometimes used in self-adjusting spacing collar devices of the kind shown in U.S. Pat. No. 4,682,906.

Figure 4:
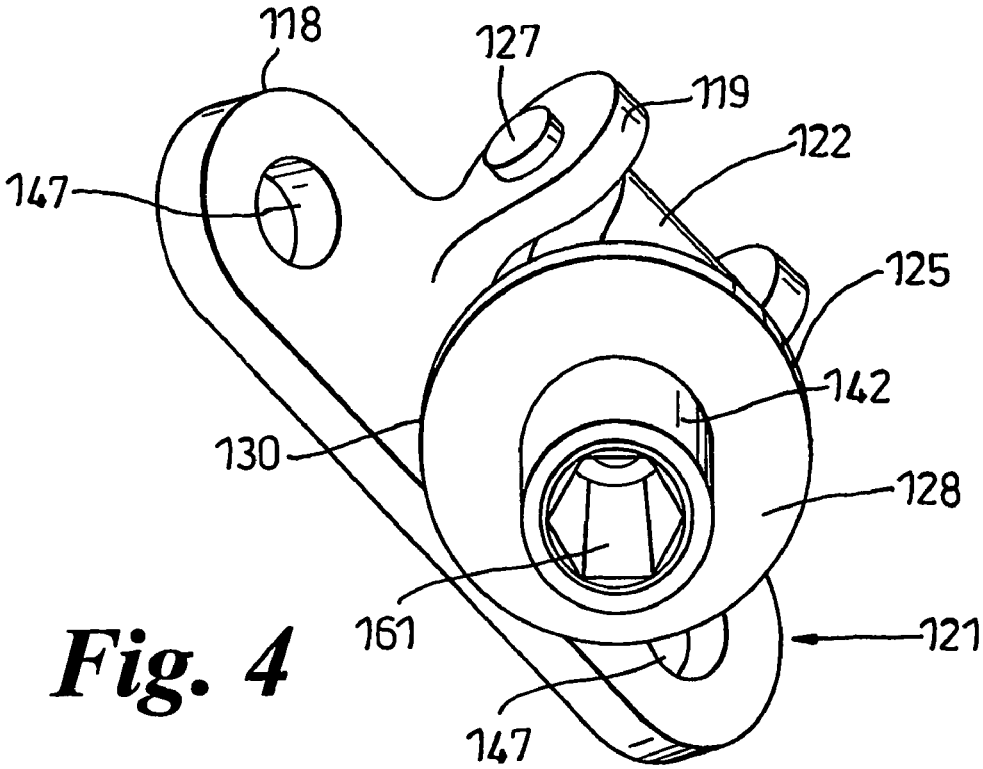
FIG. 4 is a perspective view of the hinge assembly in FIG. 2, as taken in the direction of arrow B according to another embodiment of the invention.

In the embodiment shown in FIG. 4, similar or identical parts carry the same part number as those in FIGS. 1 through 3 with the addition of 100. The adjustment nut differs in that the there is no friction ring 46 and also that the bore of the spigot 142 has a drive means in the form of a hexagonal shaped socket portion 161 to facilitate rotation of the adjustment nut 125. In this regard, the locking screw 26 is not utilized to bring the adjustment nut to the required position. Rather, a hexagonal shaped driver is inserted into the hexagonal shaped socket portion 161 to rotate the adjustment nut 125 until the gasket 29 engages the upper flange member 55 and a pre-determined torque has been reached. The hexagonal shaped driver is then removed and the locking screw 26 is inserted into the adjustment nut 125 and tightened as detailed above. Other drive means, e.g. splines, could be provided instead of the hexagonal drive means. In this modification, the use of left and right-hand threads is beneficial when there is friction between the locking screw 26 and the adjustment nut 125, which might otherwise induce the adjustment nut to unwind when the locking screw is inserted and tightened. It will be appreciated that the setting of the adjustment nut 125 by the hexagonal shaped driver can be carried out with the tailgate 14 closed.

Figure 5:
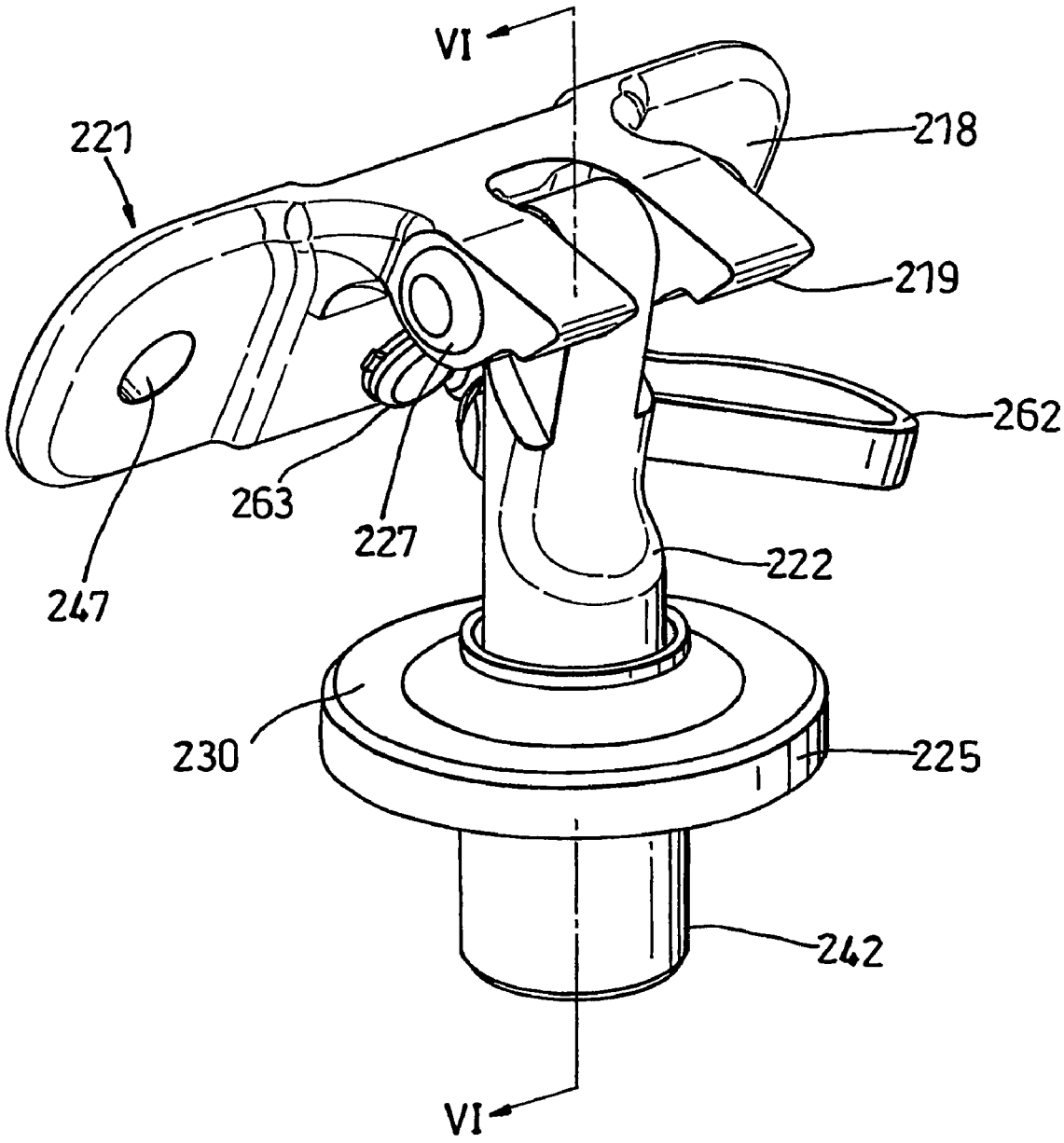
FIG. 5 is a perspective view of the hinge assembly in FIG. 3, according to yet another embodiment of the invention.
Figure 6:
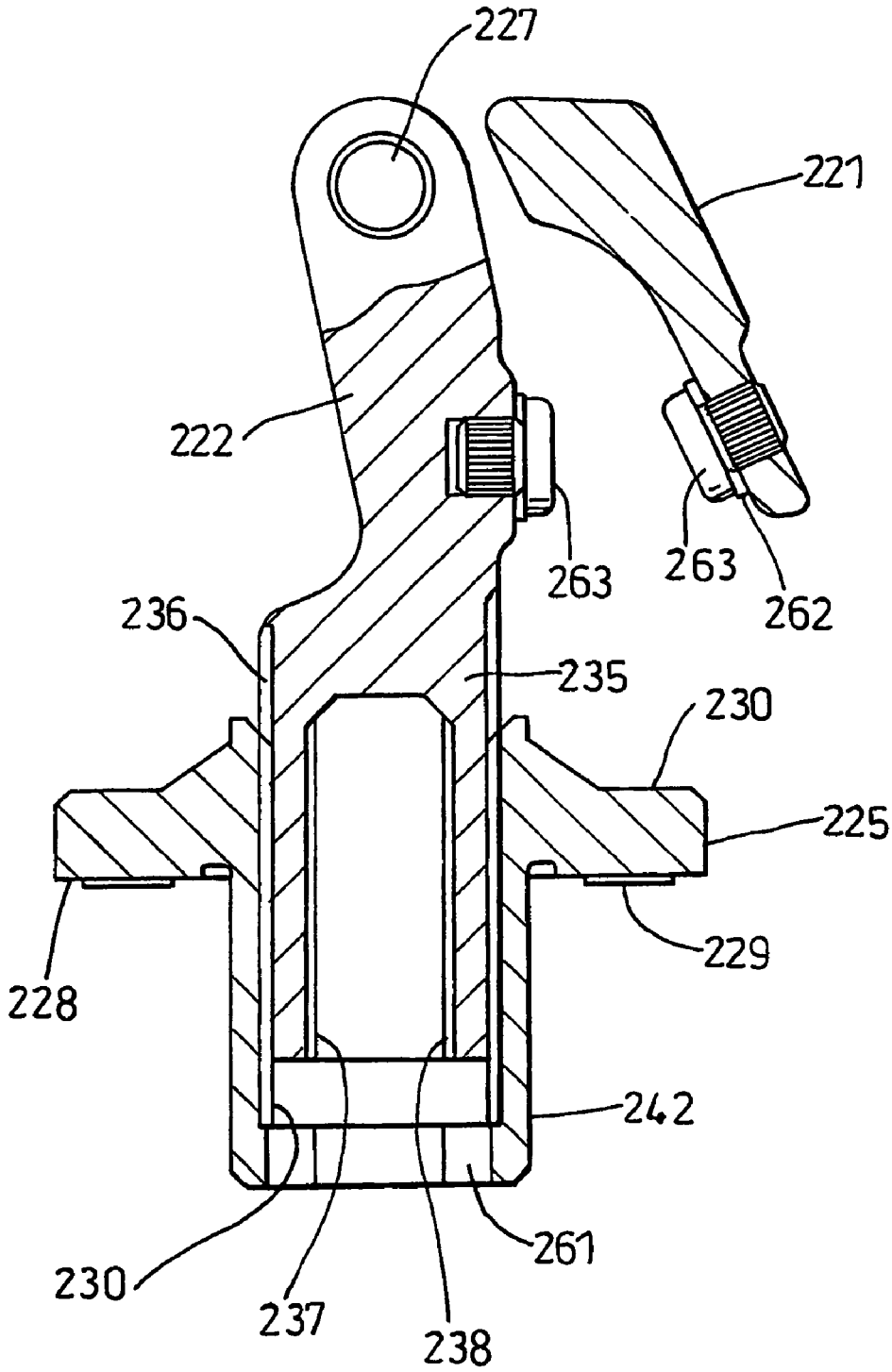
FIG. 6 is a cross-sectional view of the hinge assembly shown in FIG. 5, as taken along line VI-VI.

In another embodiment shown in FIGS. 5 and 6, similar or identical parts carry the same part number as those in FIGS. 1 through 3 with the addition of 200. The adjustment nut 225 again differs in that the there is no friction ring 46 and the bore of the spigot 242 again has a drive means in the form of a hexagonal shaped socket portion 261 to facilitate rotation of the adjustment nut 225. There is no hexagon corresponding to the hexagon 40 above the flange 230 since this is not required for assembly purposes and similar techniques can be adopted during service or repair. A grounding strap 262 is provided to ensure a good electrical connection between the hinge portions 221 and 222 and this is secured by serrated drive rivets 263.

Although the invention has been described with specific reference to a top hinged tailgate, it will be appreciated that it is equally applicable to the fixing of doors and other closures on both motor vehicle and other structures requiring accurate setting of the closure relative to the support structure. Furthermore, the second hinge member could be fastened to either the support structure or the closure member depending upon the situation with a corresponding fastening of the first hinge member to the closure member or to the support structure. It will also be appreciated that the invention is equally applicable to combination or multi-link (e.g. pantograph) hinges having several hinge members interposed between the closure member and its support structure.

What is claimed is:

1. A hinge assembly for pivotally connecting a closure member to a support structure, the hinge assembly comprising:

a first hinge member for fastening to one of the closure member and the support structure;

a second hinge member for fastening to a flange on the other of the support structure and the closure member;

a pivot means pivotally connecting the first hinge member to the second hinge member; and an adjustment device carried by the second hinge member to connect the second hinge member to the flange;

the adjustment device for adjusting the position of the second hinge member with respect to the flange;

the adjustment device comprising an adjustment nut and a locking screw;

the adjustment nut having a first clamp face which in use faces one side of the flange;

the locking screw having a head and a shank;

the head defining a second clamp face which in use faces the other side of the flange;

the shank which in use extends through an aperture in the flange;

the second hinge member comprising a cylindrical shank portion with a concentric bore and having internal and external screw threads;

the adjustment nut having an adjustment screw thread engaged with the external screw thread of the cylindrical shank portion;

the locking screw having a locking screw thread engaged with the internal screw thread of the cylindrical shank portion.

2. A hinge assembly as claimed in claim 1 wherein the adjustment device includes a spigot which in use engages the aperture in the flange with a substantial clearance.

3. A hinge assembly as claimed in claim 2 wherein the spigot extends from the adjustment nut.

4. A hinge assembly as claimed in claim 1 wherein a sealing gasket is interposed between the adjustment nut and said one side of the flange.

5. A hinge assembly as claimed in claim 1 wherein a washer is interposed between the head of the locking screw and said other side of the flange.

6. A hinge assembly as claimed in claim 1 wherein the external screw thread of the cylindrical shank portion and the adjustment screw thread of the adjustment nut are of the opposite hand to the internal screw thread of the cylindrical shank portion and the locking screw thread of the locking screw.

7. A hinge assembly as claimed in claim 6 wherein the external screw thread of the cylindrical shank portion and the adjustment screw thread of the adjustment nut are left-hand and the internal screw thread of the cylindrical shank portion and the locking screw thread of the locking screw are right-hand.

8. A hinge assembly as claimed in claim 1 and further comprising a friction means on one of the locking screw and the adjustment nut for providing a driving torque between the locking screw and the adjustment nut.

9. A hinge assembly as claimed in claim 1 further comprising a drive means used to facilitate rotation of the adjustment nut during adjustment of the hinge assembly.

10. A hinge assembly as claimed in claim 9 wherein the adjustment nut has a bore with the drive means formed therein.

11. A hinge assembly as claimed in claim 10 wherein the drive means is a hexagonal shaped portion of the bore of the adjustment nut.

12. A motor vehicle comprising:

a body structure;

a closure member; and a hinge assembly connecting the closure member to the body structure;

the hinge assembly comprising a first hinge member, a second hinge member, a pivot means pivotally connecting the first hinge member to the second hinge member, and an adjustment device carried by the second hinge member;

the first hinge member for fastening to one of the closure member and the support structure;

the second hinge member for fastening to a flange on the other of the support structure and the closure member;

the adjustment device for adjusting the position of the second hinge member with respect to the flange;

the adjustment device comprising an adjustment nut and a locking screw;

the adjustment nut having a first clamp face which in use faces one side of the flange;

the locking screw having a head and a shank;

the head defining a second clamp face which in use faces the other side of the flange;

the shank which in use extends through an aperture in the flange;

the second hinge member comprising a cylindrical shank portion with a concentric bore and having internal and external screw threads;

the adjustment nut having an adjustment screw thread engaged with the external screw thread of the cylindrical shank portion;

the locking screw having a locking screw thread engaged with the internal screw thread of the cylindrical shank portion.

13. A motor vehicle as claimed in claim 12 wherein the flange comprises two spaced apart flange members defining a cavity therebetween, the adjustment nut being positioned so as to react against one of the flange members and the locking screw being arranged so as to react against the other of the flange members.

14. A motor vehicle as claimed in claim 13 wherein a tubular spacer is positioned in the cavity between the flange members to react a clamping force applied to the flange members by the locking screw and the adjustment nut.

15. A motor vehicle as claimed in claim 12 further comprising:

a friction means coupled to one of the locking screw and the adjustment nut for providing a driving torque between the locking screw and the adjustment nut.

* * * * *

UNITED STATES PATENT AND TRADEMARK OFFICE

CERTIFICATE OF CORRECTION

PATENT NO. : 7,308,732 B2
APPLICATION NO. : 10/536661
DATED : December 18, 2007
INVENTOR(S) : Timothy Woolcock It is certified that error appears in the above-identified patent and that said Letters Patent is hereby corrected as shown below:

Column 1, Line 63, should read as follows: -- which in use faces the other side of the flange, and a shank, --

Column 2, Line 57, should read as follows: -- position. The adjustment nut is then rotated to bring the first --

Column 3, Line 3, should read as follows: -- with reference to the accompany drawings: --

Column 4, Line 4, should read as follows: -- The hollow flange 34 is formed by an upper pressing 51, --

Column 4, Line 58, should read as follows: -- brought into its correct position, with the spacer 58 having --

Column 4, Line 66, should read as follows: -- the thread 41 engages the friction ring 46. The thread 41 --

Column 5, Line 9, should read as follows: --locking screw 26 will then continue to rotate without further --

Column 5, Line 35, should read as follows: -- the external thread 36 of the second hinge member 22 with the --

UNITED STATES PATENT AND TRADEMARK OFFICE

CERTIFICATE OF CORRECTION

PATENT NO. : 7,308,732 B2
APPLICATION NO. : 10/536661
DATED : December 18, 2007
INVENTOR(S) : Timothy Woolcock It is certified that error appears in the above-identified patent and that said Letters Patent is hereby corrected as shown below:

Column 5, Line 50, should read as follows: -- 3 with the addition of 100. The adjustment nut 125 differs in that --

Column 5, Line 51, should read as follows: -- there is no friction ring 46 and also that the bore of the --

Column 6, Line 7, should read as follows: -- nut 225 again differs in that there is no friction ring 46 --

Signed and Sealed this

Twenty-seventh Day of May, 2008

JON W. DUDAS
*Director of the United States Patent and Trademark Office*